US005289495A

United States Patent [19]

Johnson

[11] Patent Number: 5,289,495

[45] Date of Patent: Feb. 22, 1994

[54] COOLANT COILS FOR A SMELTING FURNACE ROOF

[75] Inventor: Eric N. Johnson, Clinton, Iowa

[73] Assignee: J. T. Cullen Co., Inc., Fulton, Ill.

[21] Appl. No.: 931,021

[22] Filed: Aug. 17, 1992

[51] Int. Cl.[5] ..... F27D 1/02; F27D 1/12

[52] U.S. Cl. ..... 373/74; 373/71; 373/73; 432/250; 432/238; 110/331

[58] Field of Search ..... 373/73, 74, 75, 76; 432/237, 238, 248, 250; 266/241; 110/331, 335, 336

[56] References Cited

U.S. PATENT DOCUMENTS

| | | | |
|---|---|---|---|
| 1,635,819 | 7/1927 | Corcoran | 432/238 |
| 4,021,603 | 5/1977 | Nanjyo et al. | 373/74 |
| 4,207,060 | 6/1980 | Zangs | 432/77 |
| 4,216,348 | 8/1980 | Greenberger | 373/74 |
| 4,273,949 | 6/1981 | Fischer et al. | 373/74 |
| 4,345,332 | 8/1982 | Wronka | 373/74 |
| 4,417,343 | 11/1983 | Yamamoto | 373/73 |
| 4,425,656 | 1/1984 | Kuhlmann | 373/74 |
| 4,443,880 | 4/1984 | Buhler et al. | 373/74 |
| 4,445,220 | 4/1984 | Kuhlmann | 373/74 |
| 4,453,253 | 6/1984 | Lauria et al. | 373/74 |
| 4,633,480 | 12/1986 | Bleimann | 373/74 |
| 4,644,558 | 2/1987 | Kerr | 373/74 |
| 4,715,042 | 12/1987 | Heggart et al. | 373/74 |
| 4,813,055 | 3/1989 | Heggart et al. | 373/74 |

*Primary Examiner*—Bruce A. Reynolds
*Assistant Examiner*—Tu Hoang
*Attorney, Agent, or Firm*—Zarley, McKee, Thomte, Voorhees, & Sease

[57] ABSTRACT

A roof structure for an electric arc smelting furnace includes a spider frame for supporting a plurality of independent removable coolant coil sections. An inner coil section is generally annular in shape and includes a coolant pipe which spirals completely around a central opening in the roof structure. An intermediate coil section is also generally annular in shape, but includes a coolant pipe which extends around the circumference of the inner section, reverses itself around the circumference of the first pipe of the intermediate section, and then reverses itself once again around the circumference of the second coolant pipe of the intermediate section, to form a generally serpentine pattern. A plurality of semi-annular outer coil sections are supported radially outwardly from the intermediate coil section. Each outer section includes a first pipe located generally centrally within the semi-annular section and extending from end to end. A second pipe reverses the coolant flow and is located radially outwardly from the first pipe. A third coolant pipe is connected to the second coolant pipe and is located radially inwardly of the first coolant pipe within the outer section.

24 Claims, 3 Drawing Sheets

COOLANT COILS FOR A SMELTING FURNACE ROOF

TECHNICAL FIELD

The present invention relates generally to electric arc smelting furnaces, and more particularly to an improved furnace roof structure with removable coolant coils.

BACKGROUND OF THE INVENTION

Electric arc furnaces are utilized in the production of steel from scrap and the like. Smelting furnaces typically are designed as welded steel structures with water cooled walls and roof panels to protect the structure against the high temperatures of the furnace.

Currently, furnace roofs are provided with a plurality of generally pie-shaped cooling coil panels made from pipes which are removably mounted to a spider frame on the roof. In this way, failure of weld joints or the pipe may be repaired by removing and replacing one of the removable coil panels.

However, current cooling coil panels suffer several drawbacks. Each prior art panel is typically formed from lengths of pipe connected in a serpentine shape with gradually increasing lengths of pipe between end caps. Thus, in forming a "pie-shaped" panel, the point of the panel has a very short length of pipe between a pair of generally U-shaped end caps to return the pipe in the opposite direction. It can be seen that in such a design, many turns in the pipe are necessary to create the desired shape. Each such turn requires welded joints, which are the main areas of failure in such coolant coils. Each turn in the pipe also forms a restriction to water flow through the pipe, thereby reducing the velocity of water flow and increasing the pressure within the pipe.

Another problem with prior art pie-shaped designs for cooling coil panels lies in the fact that higher stresses and greater failure rates occur near the center of the roof section as compared to the outer peripheral region of the roof section. Thus, a pie-shaped panel is more likely to have only a small portion of the coil damaged by heat and stress near the point of the pie-shaped section. The replacement of such a panel thereby throws out a large portion of cooling coil which has not been damaged, thereby increasing maintenance costs and wasting materials.

Finally, the pie-shaped design of prior art coil panels utilizes a serpentine arrangement of pipe with the adjacent pipe lengths welded together and connected by caps with a tight 180° turn. Such a serpentine design restricts expansion, and builds greater stresses on each weld because of the number of tight caps which are utilized.

It is therefore a general object of the present invention to provide an improved electric arc furnace roof with removable cooling coils.

Another object of the present invention is to provide a furnace roof with cooling coils which have fewer turns than conventional serpentine designs of pie-shaped panels.

Yet another object is to provide a furnace roof with a plurality of cooling coils designed to permit replacement of coils in high stress areas independently of coils in lower stress areas of the roof.

These and other objects will be apparent to those skilled in the art.

SUMMARY OF THE INVENTION

The roof structure for an electric arc smelting furnace of the present invention includes a spider frame for supporting a plurality of independent removable coolant coil sections. An inner coil section is generally annular in shape and includes a coolant pipe which spirals completely around a central opening in the roof structure. An intermediate coil section is also generally annular in shape, but includes a coolant pipe which extends around the circumference of the inner section, reverses itself around the circumference of the first pipe of the intermediate section, and then reverses itself one again around the circumference of the second coolant pipe of the intermediate section, to form a generally serpentine pattern A plurality of semi-annular outer coil sections are supported radially outwardly from the intermediate coil section. Each outer section includes a first pipe located generally centrally within the semi-annular section and extending from end to end. A second pipe reverses the coolant flow and is located radially outwardly from the first pipe. A third coolant pipe is connected to the second coolant pipe and is located radially inwardly of the first coolant pipe within the outer section.

DESCRIPTION OF THE PREFERRED EMBODIMENT

Figure 1:
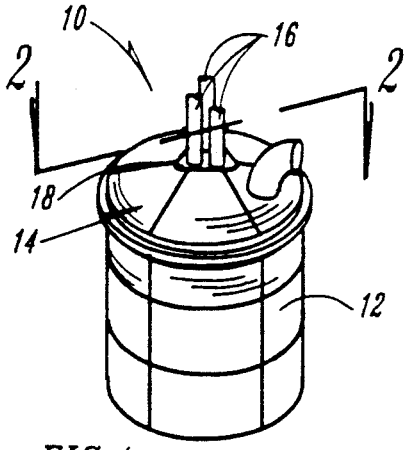
FIG. 1 is a perspective view of the exterior of an electric arc furnace of the present invention.

Referring now to the drawings, in which similar or corresponding parts are identified with the same reference numeral, and more particularly to FIG. 1, an electric arc smelting furnace is designated generally at 10 and includes a generally cylindrical container 12 and a circular roof 14. Three electrodes 16 project upwardly through a central opening 18 in roof 14, which heat the interior of container 12.

Figure 2:
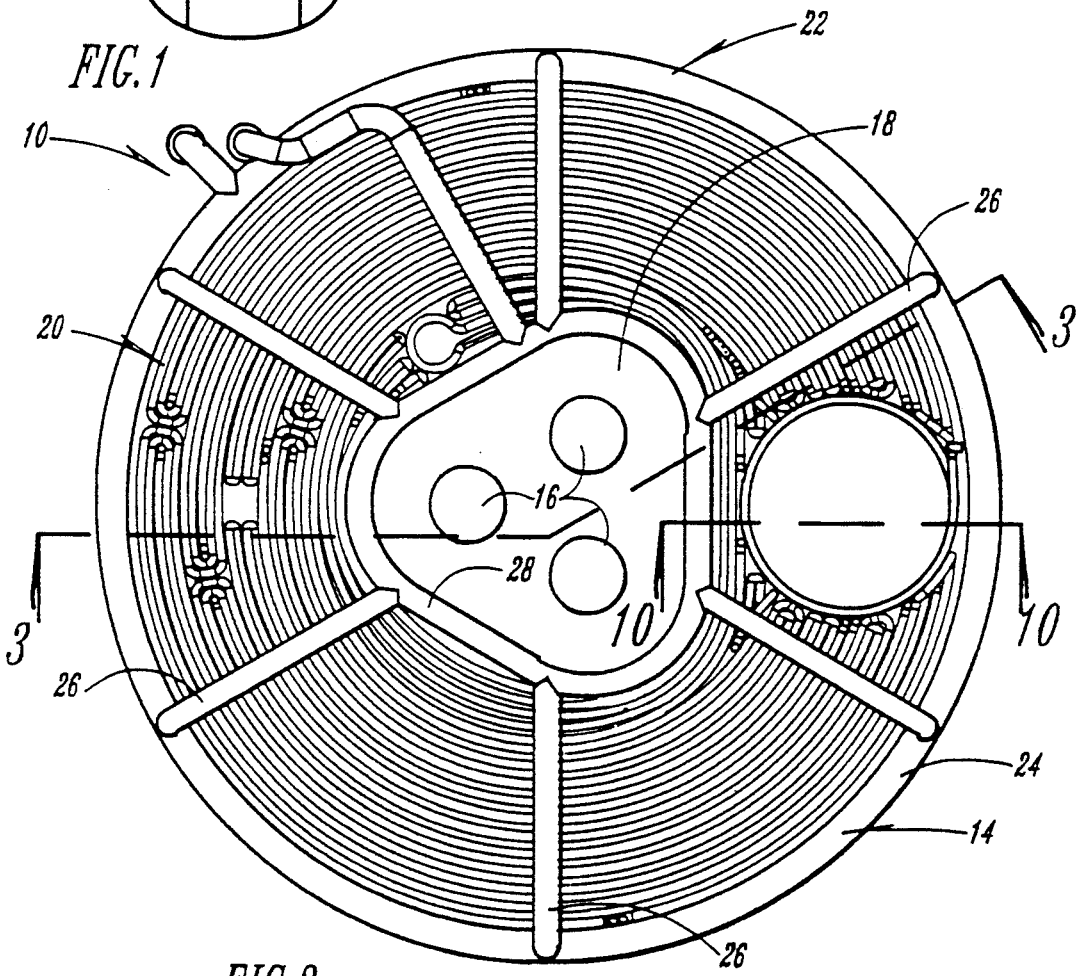
FIG. 2 is an enlarged top view of the roof of the furnace of FIG. 1.
Figure 3:
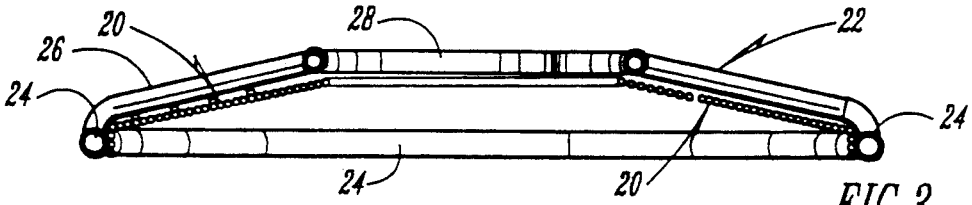
FIG. 3 is a sectional view taken at lines 3—3 in FIG. 2.

Referring now to FIG. 2, the cooling coil panels of the present invention are designated generally at 20 and are suspended from a spider frame 22. Frame 22 includes an outer pipe extending around the circumference of frame 22 to form an outer ring 24. A plurality of spokes 26 are formed from pipes extending radially inwardly from outer ring 24 to an inner ring 28. Cooling coil panels 20 are then suspended from spokes 26, as shown in FIG. 3.

Figure 4:
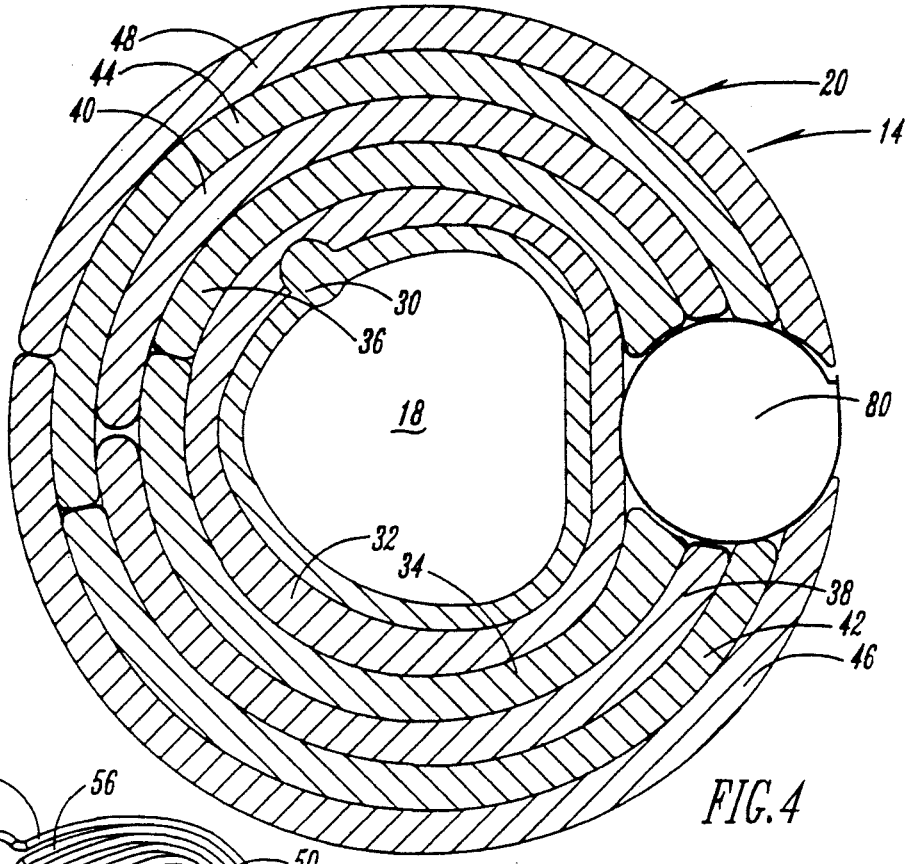
FIG. 4 is a schematic plan of the coolant coil sections of the furnace roof.

FIG. 4 is a schematic view of all of the coolant coil panels 20 utilized in conjunction with the furnace roof 14 of FIG. 1. For purposes of clarity, cooling coil panels 20 have been separately identified in three main categories: (1) inner loop section 30; (2) intermediate loop section 32; and (3) outer loop sections 34, 36, 38, 40, 42, 44, 46 and 48. Each coolant coil loop section 30–48 is removable, to permit easy repair or replacement. Inner loop section 30 and intermediate loop section 32 each extend substantially 360° around central opening 18, to form generally annular shapes, with intermediate loop section 32 concentric with and extending radially outwardly from inner loop section 30. Outer loop sections 34–48 are shaped like a semi-annulus extending substantially 180° around central opening 18 and the next adjacent loop section. Thus, outer loop sections 34 and 36 are substantially identical and are mounted to form a substantially 360° ring radially exterior of intermediate loop section 32. Similarly, outer loop sections 38 and 40 are substantially the same and are located radially exterior of outer loop sections 34 and 36 respectively. Outer loop sections 42 and 44 correspond with one another in the same fashion, and outer loop sections 46 and 48 form the outer most ring of the cooling coil panels 20. It can be seen that this arrangement of cooling coil loop sections extending generally circumferentially around central opening 18 permits simple replacement of an inner section of the cooling coils without requiring the replacement of portions of the outer ring coils. Since the temperatures and stresses on the inner loop sections are typically greater than those on the outer sections, there is less waste involved in replacing only those coils which are damaged or are in need of repair.

Figure 5:
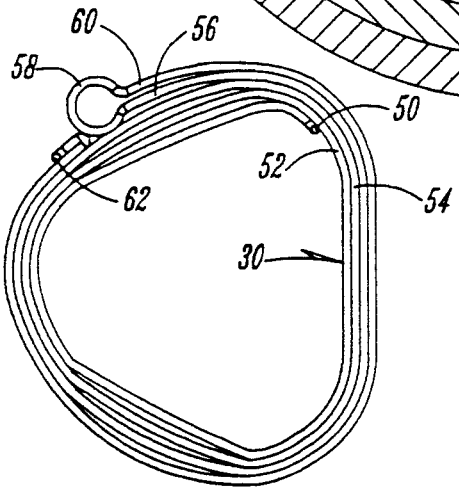
FIG. 5 is a top plan view of the inner loop cooling coil section of FIG. 4.

The inner loop section 30 is shown in more detail in FIG. 5. Inner loop 30 begins at inlet 50 and extends in an expanding spiral around central opening 18, the spiral having an increasing diameter so as to circumnavigate opening 18 three times to form three coils 52, 54 and 56. Coil 56 reverses direction at a three-quarter circle 58 and a fourth coil 60 extends in a reverse direction around third coil 56 until again reaching three-quarter circle 58, wherein the circuit of inner loop section 30 is exhausted at outlet 62.

Figure 6:
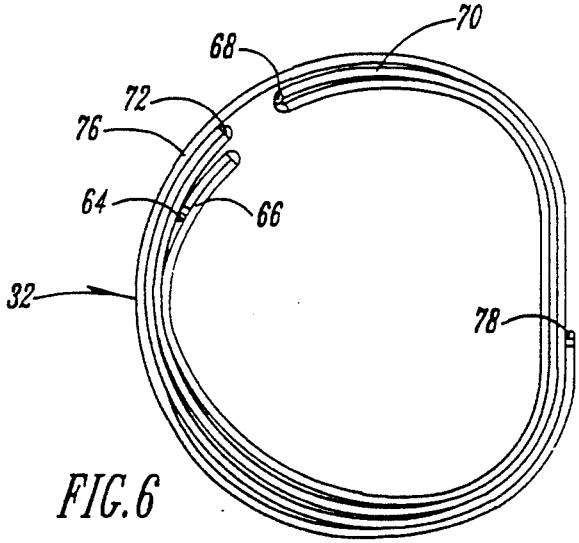
FIG. 6 is a top plan view of an intermediate loop cooling coil section of FIG. 4.

Referring now to FIG. 6, intermediate loop section 32 is shown in greater detail. From inlet 64, a first coil 66 extends around the perimeter of the inner loop section (not shown in FIG. 6) to a location immediately adjacent the location of three-quarter circle 58 (see FIG. 5). A 180° elbow 68 reverses the direction of fluid flow to form a second coil 70 which extends adjacent first coil 66 around the perimeter of the first coil and past inlet 64 to a location adjacent three-quarter circle 58. A cap 72 again reverses the fluid flow to form a third coil 74 which extends completely around the second coil and beyond cap 72 to form a fourth coil 76 extending to an outlet 78.

Figure 7:
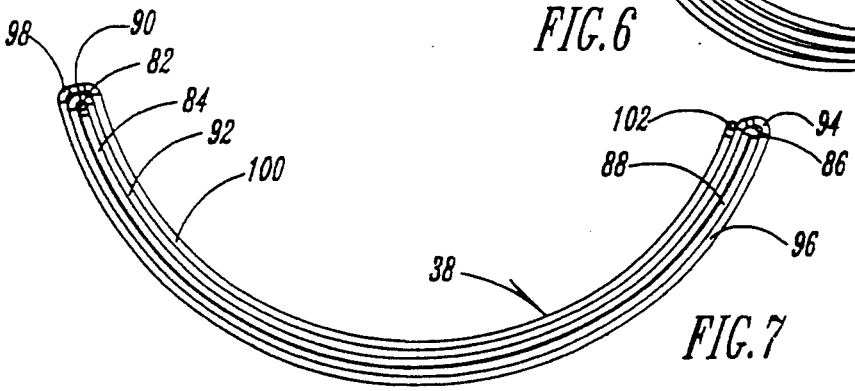
FIG. 7 is a top plan view of an outer loop cooling coil section of FIG. 4.

A smoke hole 80 is formed in roof 14, as shown in FIGS. 2 and 4, and cooling coil panels 20 extend into contact therewith. Referring now to FIG. 7, outer loop section 38 is shown in more detail. It should be noted that outer loop sections 36, 40, 42, 44, 46 and 48 are substantially the same as outer loop section 38, and therefore the other outer loop sections will not be detailed beyond that already described hereinabove. Outer loop section 38 is generally semi-annular in shape and includes a left end 38A and a right end 38B. An inlet 82 is located at left end 38A of loop section 38 and the first coil 84 extends from inlet 82 along the longitudinal center line of loop section 38, to the opposite end 38B. A cap 86 reverses the fluid flow in first coil 84 and initiates the second coil 88. Second coil 88 is located radially outwardly from first coil 86 and extends there along to the left end 38A of loop section 38. A 180° elbow 90 redirects fluid from second coil 88 to a third coil 92 located radially inwardly of first coil 84. Third coil 92 extends to right end 38B of section 38 where it is connected to a pair of elbows forming a U-shaped joint 94. U-shaped joint 94 directs fluid flow to a fourth coil 96 located radially outwardly of second coil 88, and extends to left end 38A. Another U-shaped joint 98 connects fourth coil 96 to the fifth coil 100 which is located radially interiorally of third coil 92 and extends to the right end 38B of section 38 to outlet 102.

Figure 8:
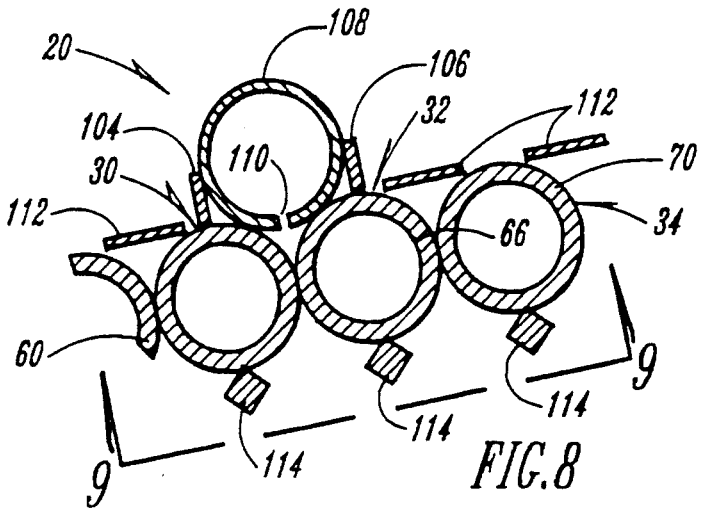
FIG. 8 is a sectional view through a joint connecting two separate cooling coil sections.

Referring now to FIG. 8, a typical joint between a pair of loop sections is shown. For ease of description, a typical joint between inner loop section 30 and intermediate loop section 32 is shown. A flat strap 104 is mounted along the outer most coil 60 of inner loop section 30, on the upper surface thereof. A similar strap 106 is mounted on the upper surface of intermediate loop section 32 inner most coil 66 (which is positioned immediately adjacent coil 60 of inter loop section 30). Straps 104 and 106 are bolted or skip welded to diametric sides of expansion pipe 108. A longitudinal split 110 is formed in expansion pipe 108 intermediate the connection of straps 104 and 106 thereto, to permit expansion between sections 30 and 32. Expansion pipe 108 is mounted to frame 22 to support the sections. Additional flat straps 112 may be located between adjacent pipe coils in order to close any gaps between the various coils.

Figure 9:
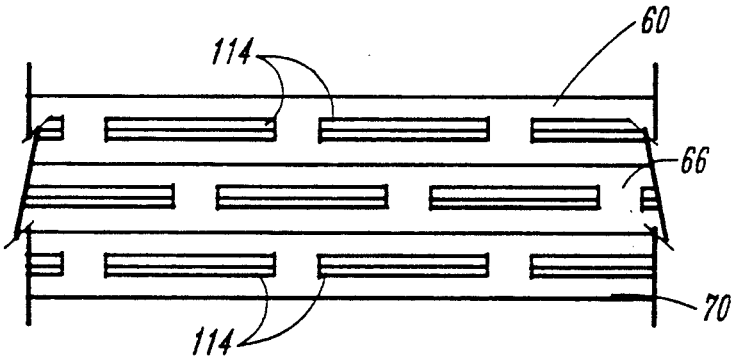
FIG. 9 is a bottom elevational view taken at lines 9—9 in FIG. 8.

Slag anchors 114 are mounted on the interior surfaces of the various coils as shown in FIGS. 8 and 9. Anchors 114 preferably are formed from short lengths of square cross section shaft mounted in staggered formation on the various coils, and serve to retain slag which splatters during the smelting process and sticks to the cooled surface of the coils. Once the splatter slag solidifies it forms an insulated layer along the inter surface of the coils.

Figure 10:
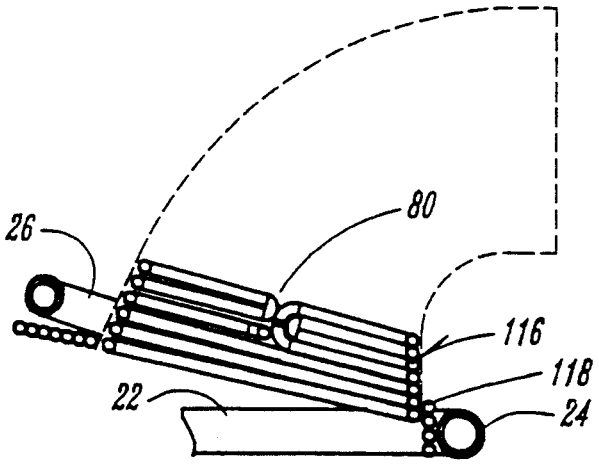
FIG. 10 is a sectional view taken at lines 10—10 in FIG. 2.

Referring now to FIG. 10, the smoke hole 80 is shown in cross sectional view. A cooling loop section 116 is provided partially upwardly along the smoke hole. Preferably, loop section 116 includes a pipe 118 which extends in a spiral helix pattern upwardly along the smoke hole.

Whereas the invention has been shown and described in connection with the preferred embodiment thereof, it will be understood that many modifications, substitutes and additions may be made which are within the intended broad scope of the appended claims. There is therefore been shown and described a roof structure for an electric arc smelting furnace which accomplishes at least all of the above stated objects.

I claim:

1. A roof structure for an electric arc smelting furnace, comprising:

a support frame for supporting removable coolant coil sections;

a removable inner coil section substantially encircling the central opening in the support frame;

said inner coil section including a cooland pipe having an inlet and outlet for the flow of coolant therethrough.

2. The roof structure of claim 1, wherein said inner coil section coolant pipe extends around said central opening in a spiral with each complete encirclement of pipe forming a coil of the spiral, said spiral including at least two generally coplanar coils.

3. The roof structure of claim 1, further comprising a first removable generally semi-annular outer coil section generally coplanar with said inner coil section and located radially outwardly of said inner coil section;

said first outer coil section including a coolant pipe having an inlet and outlet for the flow of coolant therethrough.

4. The roof structure of claim 3, wherein said first outer coil section includes a first coolant coil pipe having first and second ends and a length therebetween, the first end connected to said inlet, and wherein said outer coil section has first and second ends;

said first coil pipe extending from said inlet, located at the first end of the outer section to the second end of said outer section and the second end of the first coil pipe;

a first joint for reversing the flow of coolant, connected to the second end of said first coil pipe;

a second coil pipe having a first end connected to said first joint and extending immediately adjacent the first coil pipe for the entire length of said first coil pipe.

5. The roof structure of claim 4, further comprising:

a second joint mounted on the second end of the second coil pipe for reversing the flow of coolant from said second coil pipe; and a third coil pipe having first and second ends, the first end connected to said second joint for receiving coolant therefrom;

said third coil pipe extending immediately adjacent the first coil pipe for the entire length thereof, and opposite of said second coil pipe;

the second end of the third coil pipe connected to said outlet.

6. The roof structure of claim 3, further comprising a removable generally annular intermediate coil section coplanar with said inner and outer coil sections and interposed between said inner and outer coil sections;

said intermediate coil section including a coolant pipe having an inlet and outlet for the flow of coolant therethrough.

7. The roof structure of claim 6, wherein said intermediate section includes a first pipe coil having first and second ends, extending from said inlet of said intermediate coil substantially around said inner coil section to a second end of said first pipe coil of said intermediate section;

a first joint for reversing the flow of coolant, connected to the second end of said first coil pipe of said intermediate section;

and a second coil pipe having a first end connected to said first joint of said intermediate section and extending substantially around said inner coil section adjacent to and radially outward from said first coil pipe;

said second coil pipe of said intermediate section to said outlet.

8. A roof structure for an electric arc smelting furnace, having an opening through which electrodes extend, the roof structure comprising:

a frame;

at least one annular coolant section removably mounted on the frame and entirely encircling the opening;

at least one pair of substantially semi-annular coolant sections removably mounted on the frame and being positioned on opposite sides of the opening to cooperatively extend substantially 360° around the opening.

9. The roof structure of claim 8 wherein the annular coolant section includes a length of pipe forming a spiral path.

10. The roof structure of claim 9 wherein the pipe includes an inlet and outlet means for introduction and expulsion of coolant fluid through the annular coil.

11. The roof structure of claim 8 wherein the semi-annular coolant sections each include a length of pipe forming a reversing path.

12. The roof structure of claim 11 wherein each semi-annular section includes a first pipe, a second pipe positioned radially outwardly from the first pipe, a third pipe positioned radially inwardly from the first pipe section, a first U-shaped elbow pipe connecting the first and second pipes, and a second U-shaped elbow pipe connecting the second and third pipes for fluid flow through the semi-annular section.

13. The roof structure of claim 11 wherein each pipe includes an inlet and outlet means for introduction and expulsion of coolant fluid through the semi-annular section.

14. A roof structure for an electric arc furnace having an opening through which electrodes extend, the roof structure comprising:

a frame, a first plurality of removable coolant sections mounted on the frame to cooperatively encircle the opening;

and a second plurality of coolant sections mounted on the frame radially outwardly from the first plurality of coolant sections to cooperatively encircle the opening.

15. The roof structure of claim 14 wherein the first plurality of coolant sections each comprises a pair of semi-annular panels positioned on opposite sides of the opening.

16. The roof structure of claim 14 wherein each coolant section has an inlet and outlet means for introduction and expulsion of coolant fluid through the section.

17. The roof structure of claim 14 further comprising a third coolant section mounted on the frame radially inwardly from the first plurality of coolant sections and extending around the opening.

18. The roof structure of claim 17 wherein the third coolant section comprises at least one annular panel extending around the opening.

19. A roof structure for an electric arc smelting furnace that has a generally circular roof containing a central opening, comprising:

(a) a frame;

(b) an inner loop supported by said frame, said inner loop containing removable circular sections of cooling pipe concentric to said central opening; and (c) an outer loop supported by said frame, said outer loop containing removable semi-annular sections of cooling pipe concentric with said central opening and said inner loop.

20. The roof structure of claim 19 wherein said frame comprises:

(a) an outer ring;

(b) an inner ring concentric with said outer ring; and (c) a plurality of spokes extending radially between said inner and outer rings.

21. The roof structure of claim 19 wherein one of said circular sections of cooling pipe in said inner loop spirals outward from said central opening.

22. The roof structure of claim 19 wherein said outer loop is comprised of at least two of semi-annular sections.

23. The roof structure of claim 22 wherein one of said sections is removable without removing adjacent sections of cooling pipe.

24. The roof structure of claim 23 further comprising an intermediate ring concentric with said outer ring, said intermediate ring containing a plurality of independently removable semi-annular sections.

* * * * *

UNITED STATES PATENT AND TRADEMARK OFFICE

CERTIFICATE OF CORRECTION

PATENT NO. : 5,289,495

DATED : February 22, 1994

INVENTOR(S) : JOHNSON, Eric N.

It is certified that error appears in the above-identified patent and that said Letters Patent is hereby corrected as shown below:

In column 4, line 65 please delete "the" and insert

— a —.

In column 4, line 66 please delete "cooland" and insert

— coolant —.

Signed and Sealed this

Twenty-ninth Day of May, 2001

Nicholas P. Godici

*Attest:*

NICHOLAS P. GODICI

*Attesting Officer*

*Acting Director of the United States Patent and Trademark Office*